US009697780B2

(12) United States Patent
Chang et al.

(10) Patent No.: US 9,697,780 B2
(45) Date of Patent: Jul. 4, 2017

(54) LCD DEVICE WITH IMAGE DITHERING FUNCTION AND RELATED METHOD OF IMAGE DITHERING

(71) Applicant: NOVATEK MICROELECTRONICS CORP., HsinChu (TW)

(72) Inventors: Yu-Pin Chang, Hsinchu County (TW); Kai-I Dai, Taoyuan County (TW); Jie-Jung Huang, Miaoli County (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 0 days.

(21) Appl. No.: 14/276,491

(22) Filed: May 13, 2014

(65) Prior Publication Data

US 2015/0062190 A1 Mar. 5, 2015

(30) Foreign Application Priority Data

Aug. 28, 2013 (TW) ..... 102130883 A

(51) Int. Cl.
*G09G 3/36* (2006.01)
*G09G 3/20* (2006.01)

(52) U.S. Cl.
CPC ..... *G09G 3/3607* (2013.01); *G09G 3/2055* (2013.01); *G09G 3/3614* (2013.01); *G09G 3/3648* (2013.01); *G09G 3/3685* (2013.01); *G09G 2320/0276* (2013.01)

(58) Field of Classification Search
CPC ..... G09G 3/2044–3/2055; G09G 2320/0276; G09G 3/36
USPC ..... 345/87–100, 596–599, 690, 694; 358/3.13
See application file for complete search history.

(56) References Cited

U.S. PATENT DOCUMENTS 5,185,602 A 2/1993 Bassetti, Jr. et al.
5,598,184 A * 1/1997 Barkans ..... 345/597
6,469,684 B1 10/2002 Cole
7,327,373 B2 2/2008 Hung
(Continued)

FOREIGN PATENT DOCUMENTS

CN 101231402 A 7/2008
TW I360797 B 3/2012

OTHER PUBLICATIONS

Taiwanese Office Action dated Jun. 2, 2015.
USPTO Office Action issued on Oct. 1, 2015, for U.S. Appl. No. 14/609,391.

*Primary Examiner* — Jennifer Mehmood
*Assistant Examiner* — James Nokham
(74) *Attorney, Agent, or Firm* — Rabin & Berdo, P.C.

(57) ABSTRACT

A liquid crystal display (LCD) device includes: a data source, for generating a N-bit pixel data, N being a positive integer; a digital gamma correction unit, coupled to the data source, for performing digital gamma correction on the pixel data to generate a (N+M)-bit digital gamma correction pixel data, M being a positive integer; an image dithering unit, coupled to the digital gamma correction unit, for performing image dithering on the digital gamma correction pixel data to generate a (N+M−K)-bit dithering compensation pixel data, K being a positive integer; and a converter, coupled to the image dithering unit, for converting the dithering compensation pixel data into an output image. A bit number of the converter is lower than a bit number of the digital gamma correction unit.

12 Claims, 9 Drawing Sheets

(56) References Cited

U.S. PATENT DOCUMENTS

| | | | | |
|---|---|---|---|---|
| 7,911,431 | B2 | 3/2011 | Jung | |
| 8,253,677 | B2 | 8/2012 | Choi et al. | |
| 2001/0043177 | A1 | 11/2001 | Huston et al. | |
| 2002/0000994 | A1 | 1/2002 | Bergstrom et al. | |
| 2002/0005854 | A1* | 1/2002 | Deering | G06T 15/005 345/596 |
| 2003/0016199 | A1* | 1/2003 | Lee et al. | 345/88 |
| 2004/0125117 | A1 | 7/2004 | Suzuki et al. | |
| 2004/0239698 | A1 | 12/2004 | Kamada et al. | |
| 2004/0246278 | A1 | 12/2004 | Elliott | |
| 2005/0162369 | A1 | 7/2005 | Kim et al. | |
| 2005/0195144 | A1 | 9/2005 | Kwon et al. | |
| 2007/0182897 | A1 | 8/2007 | Shin | |
| 2008/0068661 | A1* | 3/2008 | Hung | G06T 5/009 358/3.13 |
| 2008/0084432 | A1* | 4/2008 | Jeon | 345/690 |
| 2008/0094334 | A1* | 4/2008 | Baek et al. | 345/89 |
| 2008/0158269 | A1 | 7/2008 | Wang et al. | |
| 2008/0180378 | A1 | 7/2008 | Tang | |
| 2008/0238911 | A1 | 10/2008 | Chung et al. | |
| 2008/0284768 | A1 | 11/2008 | Yoshida et al. | |
| 2009/0009453 | A1* | 1/2009 | Furihata et al. | 345/87 |
| 2009/0021462 | A1 | 1/2009 | Furihata et al. | |
| 2009/0128584 | A1 | 5/2009 | Lee et al. | |
| 2011/0037782 | A1* | 2/2011 | Tsai et al. | 345/690 |
| 2014/0247289 | A1* | 9/2014 | Park et al. | 345/690 |

* cited by examiner

LCD DEVICE WITH IMAGE DITHERING FUNCTION AND RELATED METHOD OF IMAGE DITHERING

This application claims the benefit of Taiwan application Serial No. 102130883, filed Aug. 28, 2013, the subject matter of which is incorporated herein by reference.

BACKGROUND OF THE INVENTION

Field of the Invention

The invention relates to a liquid crystal display (LCD) and an image-dithering compensation method thereof.

Description of the Related Art

In the conventional image-dithering compensation method, a blending-like method is adopted to change the gray scale value having low bits into the gray scale value having high bits in a spatial domain and/or or in a temporal domain, which is not easily perceived by the human eye. The input image data having low bits is received and the output image having high bits is displayed.

FIGS. 1A and 1B are schematic views showing the conventional image-dithering compensation methods. FIG. 1A shows the conventional image-dithering compensation performed in the temporal domain, while FIG. 1B shows the conventional image-dithering compensation performed in the spatial domain.

As shown in FIG. 1A, a pixel array 102 includes 2×2 pixels. When the image-dithering compensation is performed, it is supposed that for example, the pixel array 102 has 0, 1, 2, 3 and 4 black pixels in five continuous frames, respectively. In this case, in the temporal domain, the human eye feels like that the color of this pixel array gradually changes from white 110, three different grays 112 to 116 (with different darkness values) to black 118 in the five continuous frames, wherein the gray 116 has the darkness color, and the gray 112 has the lightest color.

FIG. 1B is directed to the visual effect seen by the human eye when the human eye sees several neighboring pixels in the same frame. Herein, four neighboring pixels 122A to 122D are described as an example. If the pixels 122A to 122D are white (i.e., the first row of FIG. 1B), then the visual effect of the human eye recognizes that the overall color of the four pixels 122A to 122D represents the white 130, and so on. With the image-dithering compensation of FIG. 1B, the four neighboring pixels, which originally show two colors (black and white), represent five colors (white 130, grays 132 to 136 and black 138).

In order to improve image display, a digital gamma correction has been proposed to independently control the R/G/B gray scale values of each pixel/sub-pixel and to independently control the polarity of each pixel/sub-pixel.

SUMMARY OF THE INVENTION

Thus, the invention proposes a liquid crystal display (LCD) having the digital gamma correction, and an image-dithering compensation method for the same.

According to one embodiment of the present invention, a LCD is provided. The LCD includes: a data source, for generating a N-bit pixel data, N being a positive integer; a digital gamma correction unit, coupled to the data source, for performing digital gamma correction on the pixel data to generate a (N+M)-bit digital gamma correction pixel data, M being a positive integer; an image-dithering unit, coupled to the digital gamma correction unit, for performing image-dithering on the digital gamma correction pixel data to generate a (N+M−K)-bit dithering compensation pixel data, K being a positive integer; and a converter, coupled to the image-dithering unit, for converting the dithering compensation pixel data into an output image, wherein, a bit number of the converter is lower than a bit number of the digital gamma correction unit.

According to another embodiment of the present invention, an image-dithering compensation method applicable to a LCD is provided. Digital gamma correction is performed on a N-bit pixel data to generate a (N+M)-bit digital gamma correction pixel data, N and M being positive integers. Image-dithering is performed on the digital gamma correction pixel data to generate a (N+M−K)-bit dithering compensation pixel data, K being a positive integer. The dithering compensation pixel data is converted into a (N+M−K)-bit output image.

The above and other contents of the invention will become better understood with regard to the following detailed description of the preferred but non-limiting embodiment(s). The following description is made with reference to the accompanying drawings.

DETAILED DESCRIPTION OF THE INVENTION

Technical terms of the disclosure are based on general definition in the technical field of the disclosure. If the disclosure describes or explains one or some terms, definition of the terms is based on the description or explanation of the disclosure. Further, shapes, sizes and ratios of the objects are exemplary for one skilled person in the art to understand the disclosure, not to limit the disclosure.

In possible implementation, one skilled person in the art would selectively implement part or all technical features of any embodiment of the disclosure or selectively combine part or all technical features of the embodiments of the disclosure based on the disclosure of the disclosure and his/her own need.

Figure 1A:
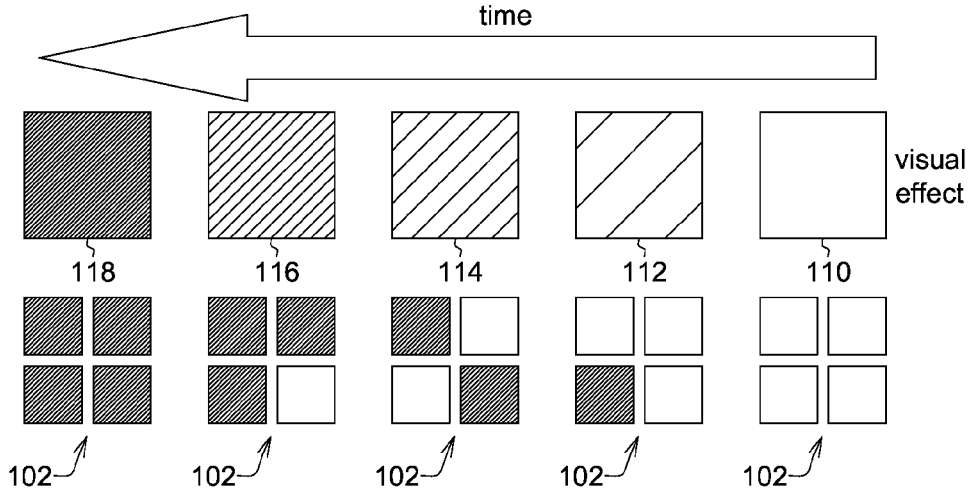
FIG. 1A (Prior Art)
FIGS. 1A and 1B (PRIOR ART) are schematic views showing conventional image-dithering compensation methods.
Figure 1B:
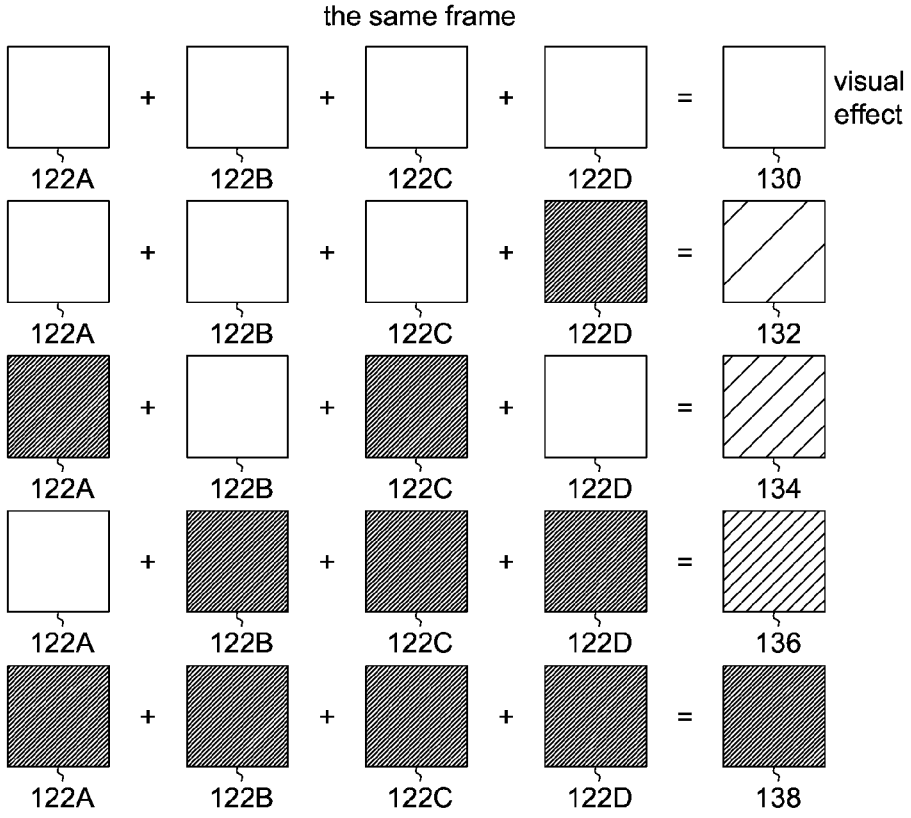
FIG. 1B (Prior Art)
Figure 2:
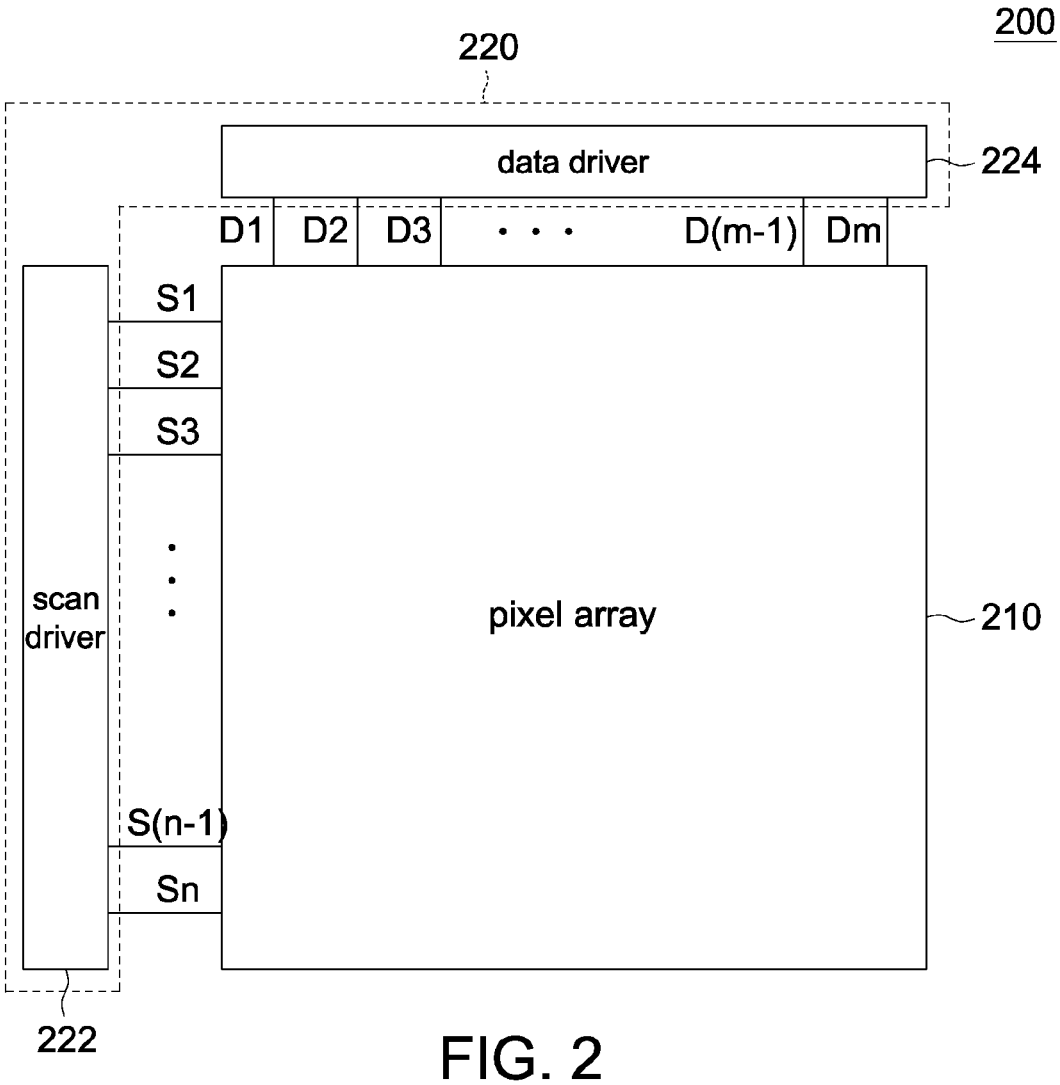
FIG. 2 is a schematic view showing a circuit diagram of a LCD.

FIG. 2 is a schematic view showing a circuit diagram of a LCD 200. Referring to FIG. 2, the LCD 200 includes a pixel array 210, scan lines S1 to Sn, data lines D1 to Dm and a driving unit 220. The pixel array 210 includes multiple pixels. The scan lines and/or the data lines are coupled between the pixel array 210 and the driving unit 220. In the LCD 200, the driving unit 220 includes a scan driver 222 and a data driver 224. Each pixel of the pixel array 210 corresponds to one of the scan lines and one of the data lines.

In the embodiment of the invention, the pixel array 210 may be driven by for example, dot inversion, column inversion, line inversion, (1+2) dot inversion, 2 dot inversion or the like without departing from the scope of the invention. The invention is not restricted by the method of driving the pixel array.

Figure 3:
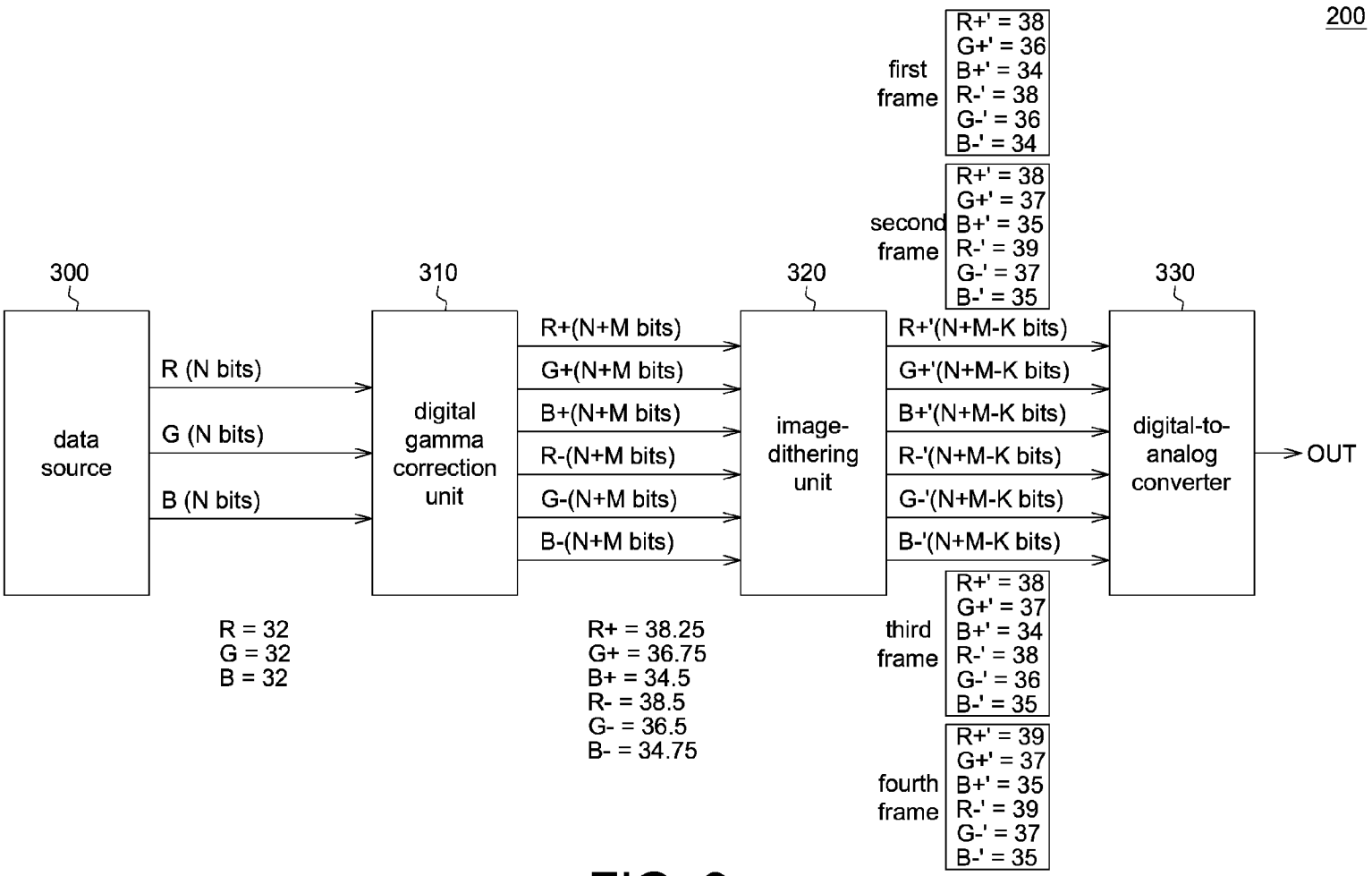
FIG. 3 is a schematic view showing the image-dithering compensation according to an embodiment of the invention.

FIG. 3 is a schematic view showing the image-dithering compensation according to an embodiment of the invention. Referring to FIG. 3, the LCD 200 further includes a data source 300, a digital gamma correction unit 310, an image-dithering unit 320 and a digital-to-analog converter 330. The data source 300, the digital gamma correction unit 310, the image-dithering unit 320 and the digital-to-analog converter 330 may be in the data driver 224 of FIG. 2.

The digital gamma correction unit 310 receives pixel data R, G and B transferred from the data source 300. In one example, each of the pixel data R, G and B has N bits (N is a positive integer). The digital gamma correction unit 310 performs digital gamma correction on the pixel data R, G and B to generate the digital gamma correction pixel data. In the embodiment of the invention, six digital gamma correction pixel data R+, G+, B+, R−, G− and B− (each of which has N+M bits, and M is a positive integer) will be described as an example, which does not intend to restrict the invention. "R+" represents the red pixel data with the positive polarity; "R−" represents the red pixel data with the negative polarity; and so on.

In the embodiment of the invention, the bit number of the digital gamma correction pixel data, which is obtained by the digital gamma correction unit 310, is higher. However, if the bit number that can be processed by a back-end unit (e.g., the digital-to-analog converter 330) is lower than the bit number of the digital gamma correction pixel data, which is obtained by the digital gamma correction unit 310, then the lower bit of the digital gamma correction pixel data is wasted (i.e., the user does not feel that he or she is watching images having high bit number) in the case if the digital-to-analog converter 330 directly converts the digital gamma correction pixel data having higher bit number.

In order to prevent waste of the low-bit of the image, when the image-dithering unit 320 of this embodiment of the invention is performing the image-dithering compensation, the digital gamma correction pixel data of the high-bit number (e.g., N+M bits) is compensated into the dithering compensation pixel data (e.g., N+M−K bits, K being a positive integer) having the lower bit number. Consequently, although the compensated pixel data has lower bit number but still higher than the bit number of the original pixel data, the user has better watching feeling because the color gradation of the image becomes enriched.

The image-dithering unit 320 receives the digital gamma correction pixel data R+, G+, B+, R−, G− and B− from the digital gamma correction unit 310, and converts into dithering compensation pixel data R+', G+', B+', R−', G−' and B−' (e.g., N+M−K bit, K being a positive integer).

The digital-to-analog converter 330 performs digital-to-analog conversion on the dithering compensation pixel data R+', G+', B+', R−', G−' and B−', compensated by the image-dithering unit 320, to obtain an output image OUT.

In order to understand the advantages of the embodiments of the invention, examples will be described in the following. However, it is to be noted that the embodiment of the invention is not restricted thereto. For the sake of understanding, the value of the pixel data is described based on the decimal system in the following.

For example, it is assumed that the pixel data R, G and B are decimally represented as 32, 32 and 32. After processed by the digital gamma correction unit 310, the six digital gamma correction pixel data R+, G+, B+, R−, G− and B− are assumed to be R+=38.25, G+=36.75, B+=34.5, R−=38.5, G−=36.5 and B−=34.75, respectively. How to perform the digital gamma correction is not particularly restricted.

After the image-dithering compensation by the image-dithering unit 320, the dithering compensation pixel data R+', G+', B+', R−', G−' and B−' are 38, 36, 34, 38, 36 and 34, respectively in the first frame; 38, 37, 35, 39, 37 and 35, respectively, in the second frame; 38, 37, 34, 38, 36 and 35, respectively, in the third frame; and 39, 37, 35, 39, 37 and 35, respectively, in the fourth frame, for example.

In terms of the visual effect seen by the human eye, the dithering compensation pixel data R+' corresponds to (38+38+38+39)/4=38.25 when the user sees the four frames. The user has similar visual effects when the user sees other dithering compensation pixel data. For the digital-to-analog converter 330 supporting low bit number, "0.25" of the digital gamma correction pixel data R+=38.25 is the mantissa (the mantissa is the lowest K bit in the N+M bits), and the digital-to-analog converter 330 may not correctly convert the mantissa. However, if the mantissa of the digital gamma correction pixel data is neglected, then the color gradation of the image display is decreased. So, in the embodiment of the invention, the image-dithering compensation is utilized to compensate the mantissa of the digital gamma correction pixel data into the dithering compensation pixel data of different frames. Consequently, the digital-to-analog converter 330 does not have to process the mantissa which the digital-to-analog converter 330 cannot process.

According to the above-mentioned example of the invention, when the image-dithering compensation is performed to compensate the pixel data having high bit number into the pixel data having low bit number, the human eye does not feel this. So, the dithering compensation method of the embodiment of the invention may effectively support the digital gamma correction.

Although the bit numbers of the digital gamma correction pixel data R+, G+, B+, R−, G− and B− are higher, the back-end digital-to-analog converter just processes data having low bit number. So, in the embodiment of the invention, when the image-dithering unit 320 performs the image-dithering compensation, the bit number of its output data (i.e. the dithering compensation pixel data R+', G+', B+', R−', G−' and B−' having (N+M−K) bits) is lower than the bit number of the input data (digital gamma correction pixel data R+, G+, B+, R−, G− and B− having (N+M) bits).

However, in other possible embodiments of the invention, if the digital-to-analog converter can process data having high bit number, then the image-dithering unit 320 may output the dithering compensation pixel data having higher bit number. This also falls within the scope of the invention.

The details of the dithering compensation of the embodiment of the invention will be described in the following.

Figure 4:
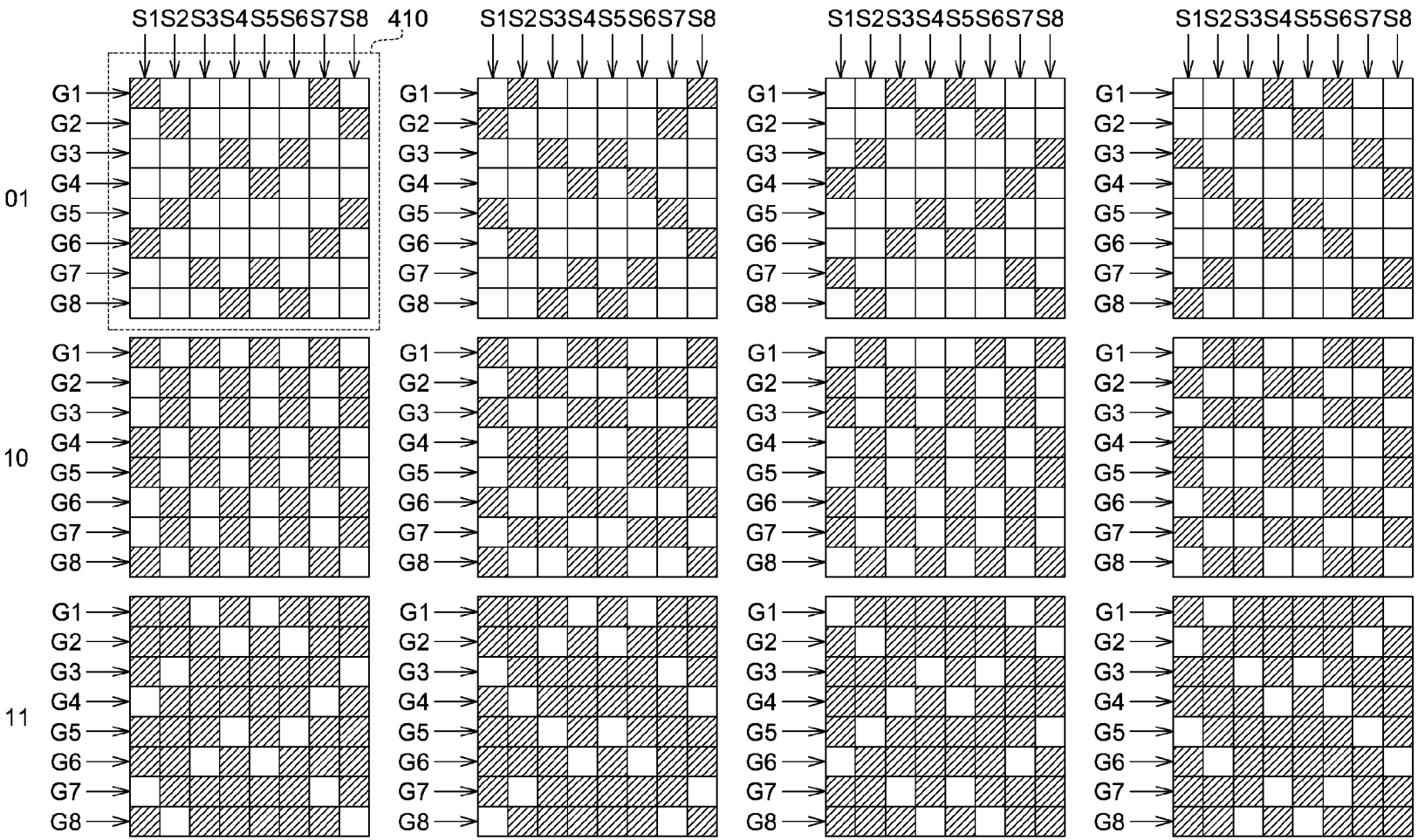
FIG. 4 shows an example of a 8×8 sub-pixel dithering compensation table applicable to the embodiment of the invention.

FIG. 4 shows an example of a 8×8 sub-pixel dithering compensation table applicable to the embodiment of the invention. The 8×8 sub-pixel dithering compensation table is used for the non-symmetrical polarity dithering compensation. It should be noted that the invention is not restricted to the application of the sub-pixel dithering compensation table of FIG. 4. Four tables associated with the mantissa "01" of FIG. 4 are applied to four continuous frames.

Figure 5:
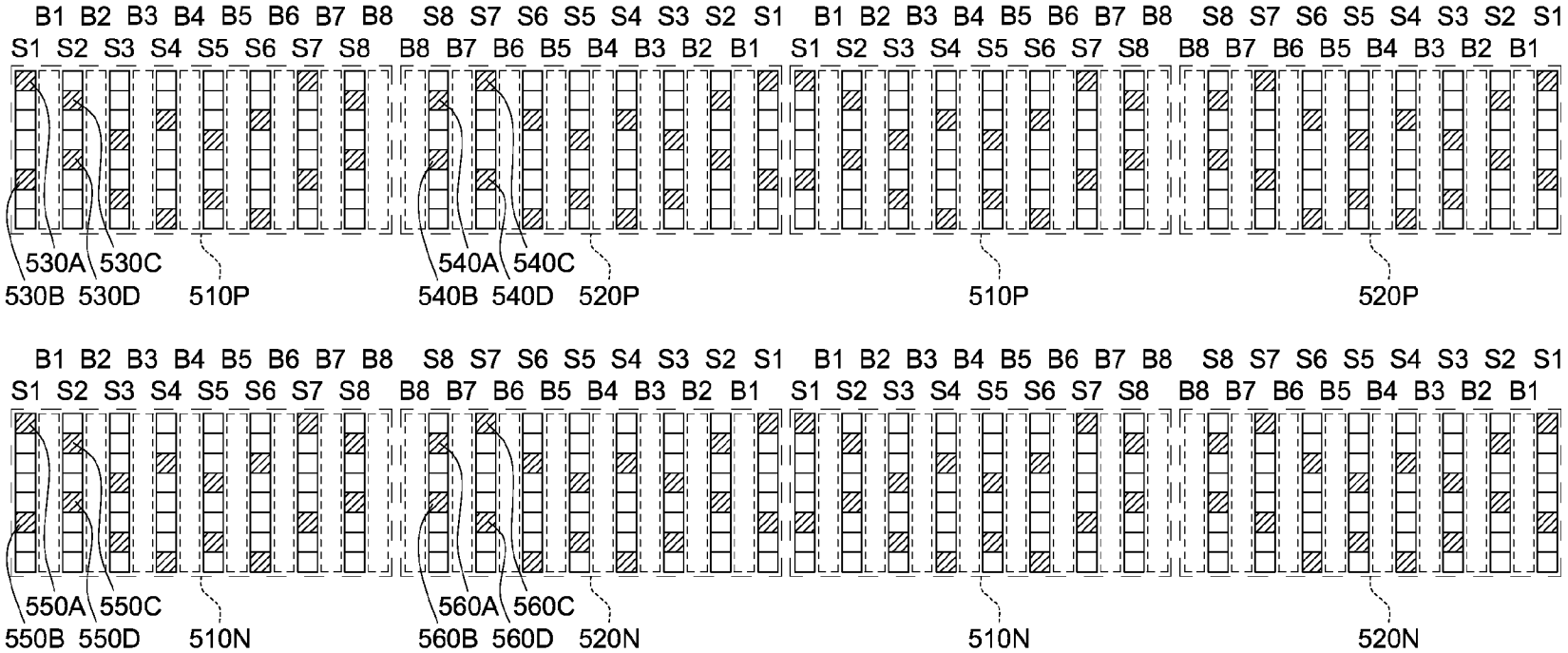
FIGS. 5 to 7 show a image-dithering compensation table and the method for forming the same according to the embodiment of the invention.

FIG. 5 shows that the 8×8 sub-pixel dithering compensation tables of FIG. 4 are duplicated and staggered to obtain a plurality of first intermediate dithering compensation tables. For the sake of explanation, the sub-pixel dithering compensation tables related to the mantissa "01" in FIG. 4 will be described as an example. If the bit number of the mantissa is 2, then the mantissa "01" may be represented as "0.25"; the mantissa "10" may be represented as "0.50"; the mantissa "11" may be represented as "0.75". That is, in the above-mentioned example, if the dithering compensation is performed on the digital gamma correction pixel data R+=38.25, outputted from the digital gamma correction unit 310, then the sub-pixel dithering compensation table related to "01" is selected.

The blank columns B1 to B8 are respectively inserted aside (e.g., on the right-hand side of) each of the columns S1 to S8 in the 8×8 sub-pixel dithering compensation table 410 of FIG. 4, as shown in the table 510P of FIG. 5. In addition, the table 520P is generated in a manner similar to that of generating the table 510P, but the table 520P and the table 510P have a mirror relationship. In this manner, the above steps are repeated to obtain two tables 510P, two tables 520P, two tables 510N and two tables 520N, wherein the table 510P and the table 510N are the same, and the table 520P and the table 520N are also the same. In the following, the table 510P and the table 520P are used for generation of the positive polarity pixel data, while the table 510N and the table 520N are used for generation of the negative polarity pixel data, so they are classified using the names.

Figure 6:
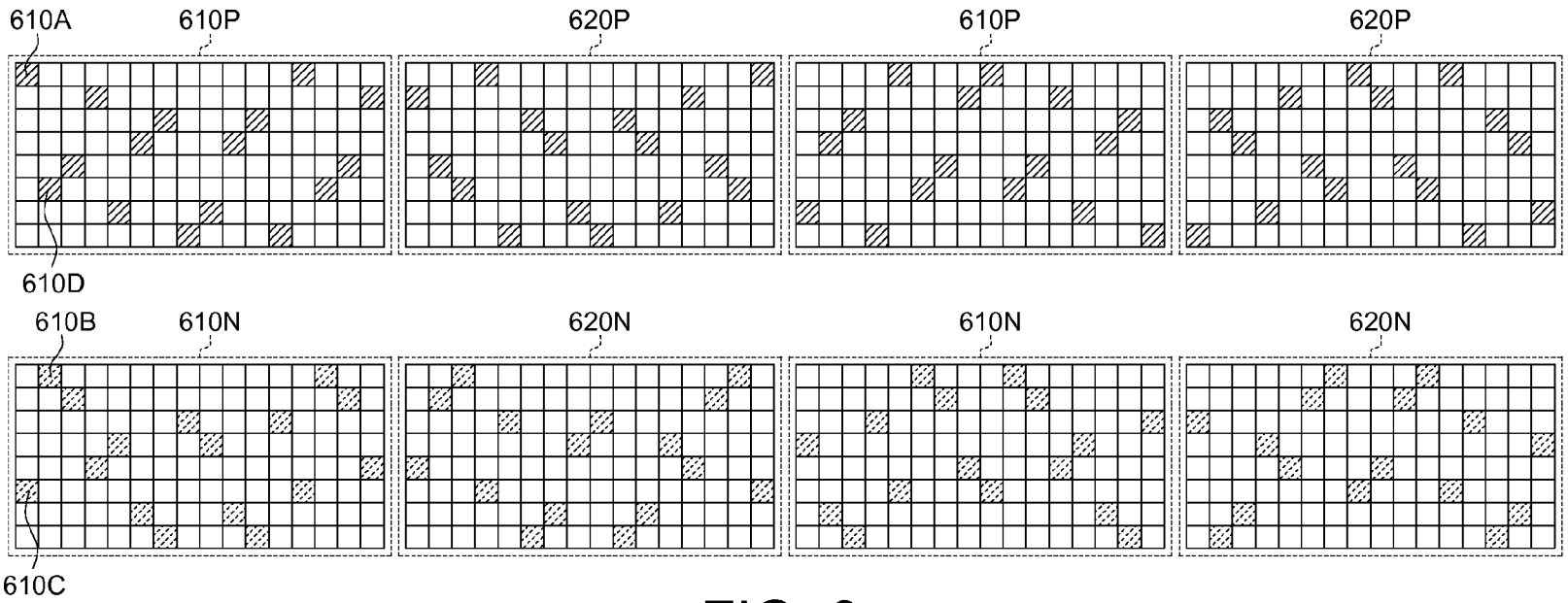

Next, each of the tables 510P, 520P, 510N and 520N in FIG. 5 is shifted to obtain the tables of FIG. 6 (also may be referred to as second intermediate dithering compensation tables). In shifting, taking the table 510P as an example, the to-be-compensated pixel 530A in the column S1 is not shifted, but the to-be-compensated pixel 530B in the column S1 is shifted one column rightwards into the blank column; the to-be-compensated pixel 530C in the column S2 is shifted one column rightwards into the blank column, but the to-be-compensated pixel 530D in the column S2 is not shifted, and so on. The table 510P of FIG. 5 is shifted as the table 610P of FIG. 6.

Taking the table 520P as an example, the to-be-compensated pixel 540A in the column S8 is not shifted, but the to-be-compensated pixel 540B in the column S8 is shifted one column rightwards into the blank column; the to-be-compensated pixel 540C in the column S7 is shifted one column rightwards into the blank column, and the to-be-compensated pixel 540D in the column S7 is not shifted; and so on. The table 520P of FIG. 5 is shifted as the table 620P of FIG. 6.

The shift of the tables 510N and 520N are slightly different from those mentioned hereinabove. Taking the table 510N as an example, the to-be-compensated pixel 550A in the column S1 is shifted one column rightwards into the blank column, while the to-be-compensated pixel 550B in the column S1 is not shifted; the to-be-compensated pixel 550C in the column S2 is not shifted, and the to-be-compensated pixel 550D in the column S2 is shifted one column rightwards into the blank column; and so on. The table 510N of FIG. 5 is shifted as the table 610N of FIG. 6.

Taking the table 520N as an example, the to-be-compensated pixel 560A in the column S8 is shifted one column rightwards into the blank column, while the to-be-compensated pixel 560B in the column S8 is not shifted; the to-be-compensated pixel 560C in the column S7 is not shifted, while the to-be-compensated pixel 560D in the column S7 is shifted one column rightwards into the blank column; and so on. The table 520N of FIG. 5 is shifted as the table 620N of FIG. 6.

Figure 7:
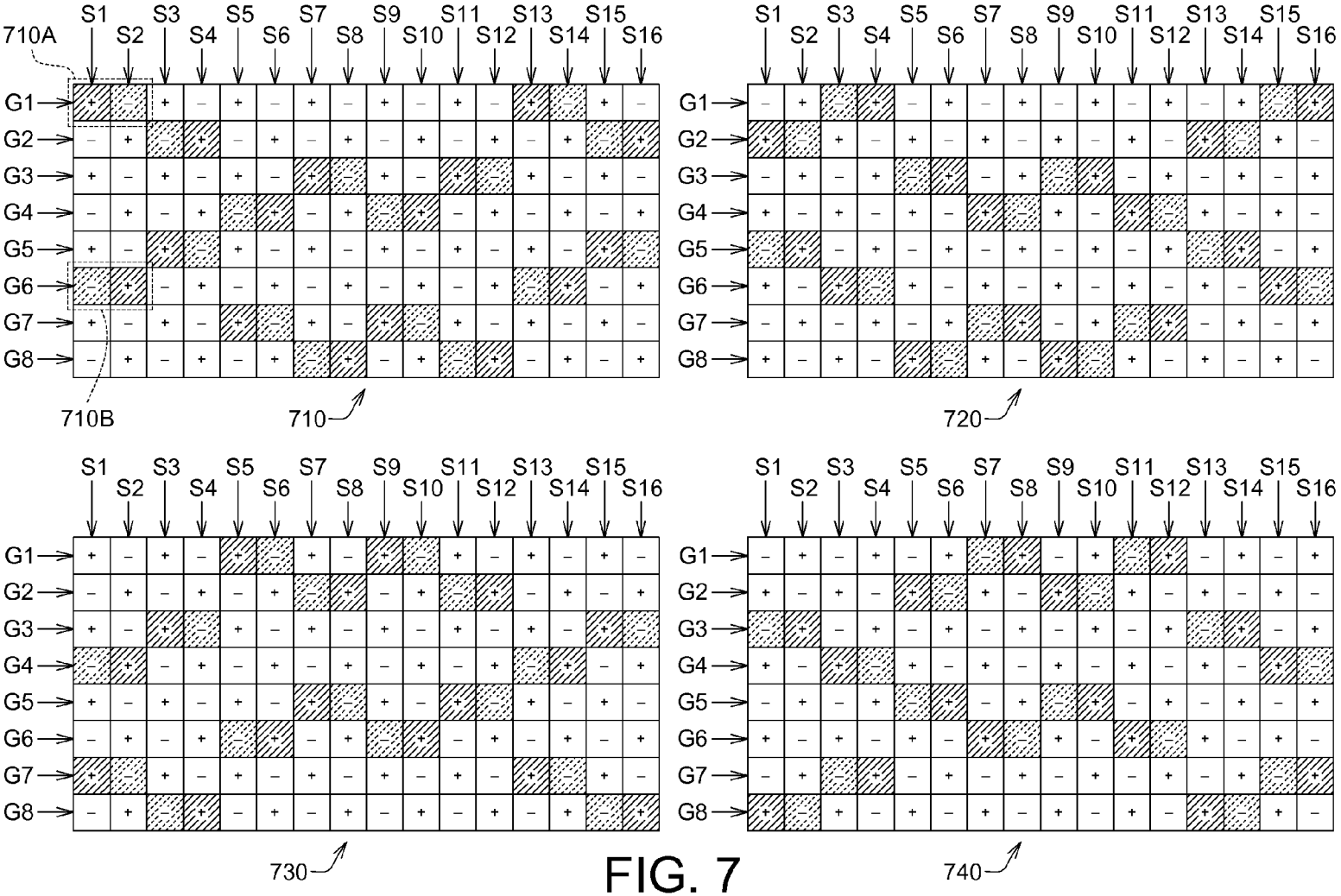

The tables of FIG. 6 are combined into the tables of FIG. 7. In table combination, the upper table and the lower table of FIG. 6 are combined. When the table 610P and the table 610N are combined, one column of the table 610P and an associated blank column of the table 610N are combined. In detail, the to-be-compensated pixel 610A of the column S1 of the table 610P and the to-be-compensated pixel 6108 of the blank column (adjacent to the column S1) of the table 610N are combined into a to-be-compensated pixel 710A; and the to-be-compensated pixel 610D of the column S1 of the table 610P and the to-be-compensated pixel 610C of the blank column (adjacent to the column S1) of the table 610N are combined into a to-be-compensated pixel 7108. In addition, the to-be-compensated pixel 710A includes two to-be-compensated sub-pixels, a first one (from the table 610P) having the positive polarity, and a second one (from the table 610N) having the negative polarity. In the similar manner, tables 720 to 740 are obtained. When the column dithering compensation is performed, the four tables 710 to 740 are applied to four continuous frames, respectively. The tables obtained in FIG. 7 may be stored in the image-dithering unit 320 of FIG. 3.

In addition, in FIGS. 4 to 7, the hatched block represents the pixel to be dithering compensated. When the column dithering compensation is performed, it is assumed that the mantissa of the digital gamma correction pixel data R+(38.25) is "01". For the sake of illustration, it is assumed that the digital gamma correction pixel data R+ corresponds to S1 and G1 in the table 410, the to-be-compensated pixel 710A in the table 710, and the to-be-compensated pixels at the same positions of the tables 720 to 740. So, when the column image-dithering compensation is performed, in the four continuous frames, the digital gamma correction pixel data R+ are compensated into 39 (in the table 710, the digital gamma correction pixel data R+ corresponds to the to-be-compensated pixel at the upper left corner, so it is compensated from 38 into 39), 38 (in the table 720, the digital gamma correction pixel data R+ corresponds to the compensation-free pixel at the upper left corner, so it is still 38), 38 and 38. This matches with the example shown in FIG. 3. But, in FIG. 3, the digital gamma correction pixel data R+ in the fourth frame is compensated. In this example, however, the digital gamma correction pixel data R+ in the first frame of the four continuous frames is compensated. However, as for any four continuous frames, the dithering compensation pixel data R+' has three "38" and one "39", respectively. So, for the human vision effect, the dithering compensation pixel data R+' is equivalent to the pixel data "38.25".

In addition, in the tables 710 to 740 of FIG. 7, the positive/negative polarity is further considered. The tables of FIG. 7 are applicable to the positive-polarity-01 negative-polarity-01 (i.e., the mantissa of the positive polarity of pixel data is 0.25, and the mantissa of the negative polarity of pixel data is 0.25). In FIG. 7, as for the block at S1-G1 and the block at S2-G1 in each table, the positive polarity pixel data in the four continuous frames are compensated once, and the negative polarity pixel data in the four continuous frames are compensated once. So, the temporal domain compensation is achieved.

For the spatial domain compensation, as for any column or any row as an example, the positive-polarity-01 negative-polarity-01 compensation may also be achieved. For example, in the table 710 of FIG. 7, taking the row G1 as an example, the positive polarity and the negative polarity pixel data are both compensated twice (the row G1 has eight positive polarity pixel data and eight negative polarity pixel data). The compensation rate thereof is 2/8=0.25 and the positive-polarity-01 negative-polarity-01 compensation is made.

Similarly, all table may be derived according to the above-mentioned descriptions. Taking the mantissa having 2 bits as an example, all nine tables (01, 01), (01, 02), (01, 03), (02, 01), (02, 02), (02, 03), (03, 01), (03, 02), (03, 03) are derived from the 8×8 image-dithering compensation tables (similar to the tables of FIG. 4) according to the above-mentioned description, wherein (01, 01) represents that the mantissa of the positive polarity pixel is 01, and the mantissa of the negative polarity pixel is 01, and so on.

In addition, the embodiment of the invention may support the dithering compensation of the independent polarity-independent RGB. In the following, the example of (01, 01, 01, 01, 01, 01, 01) representing that the mantissa of each of the digital gamma correction pixel data R+, G+, B+, R−, G− and B− is 01 (i.e., 0.25) will be described.

Figure 8:
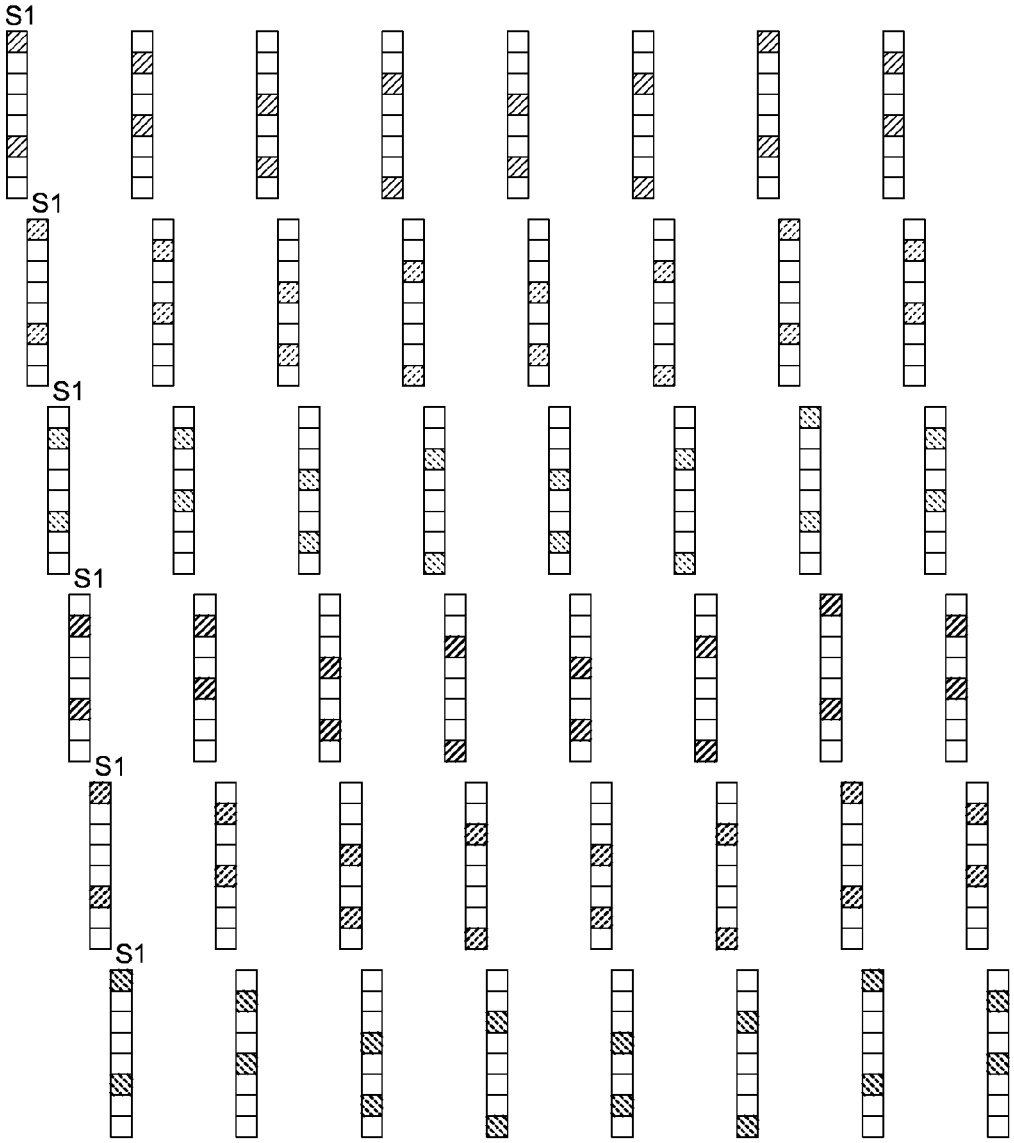
FIGS. 8 and 9 show a image-dithering compensation table and a method for forming the same according to another embodiment of the invention.

The table 410 of FIG. 4 is developed and duplicated to six copies, as shown in FIG. 8. Upon development, five blank columns are located between the columns (e.g., five blank columns between the columns S1 and S2). Next, the same columns of other five tables 410 are inserted aside this column (e.g., the columns S1 of other five tables 410 are inserted aside the column S1 of the first table 410).

Figure 9:
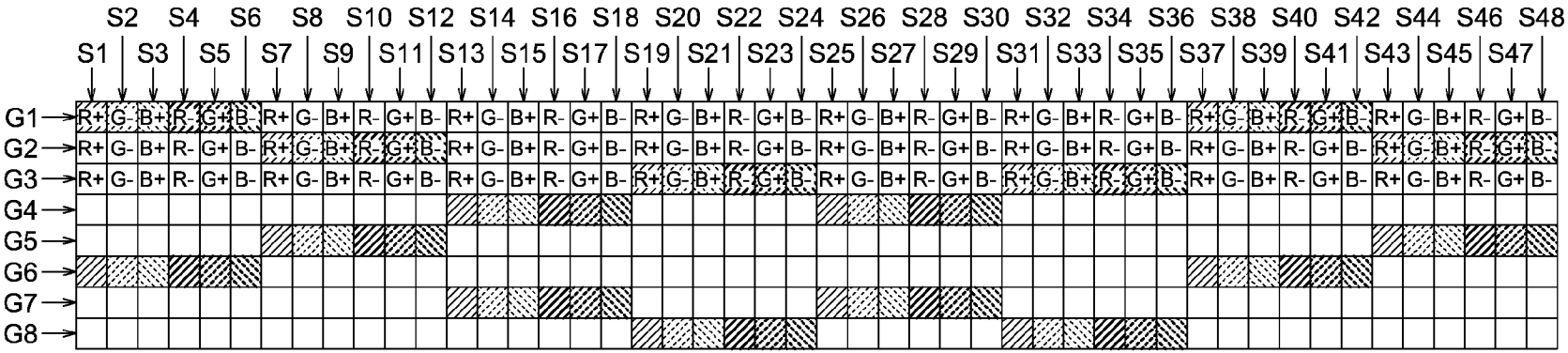

Next, the six tables 410 are combined in this manner. The combination result is shown in FIG. 9. That is, in FIG. 9, the columns S1 to S6 are the columns S1 of the six tables 410, and so on. Please note that the table obtained in FIG. 9 is used for the image-dithering compensation of a single frame. The mantissa 01 of FIG. 4 is related to four tables, respectively associated with the four continuous frames. In order to obtain the image-dithering compensation tables for other three continuous frames, other three tables of the mantissa 01 of FIG. 4 are combined in the similar manner. By doing so, it is possible to obtain the tables (which are related to continuous frames) for performing the image-dithering compensation on the six digital gamma correction pixel data R+, G+, B+, R−, G− and B− each having the same mantissa of 01 (i.e., 0.25).

Similarly, all 36 tables (01, 01, 01, 01, 01, 01, 01), (01, 01, 01, 01, 01, 01, 02), . . . , (03, 03, 03, 03, 03, 03, 03) may be derived according to the above-mentioned description Of course, in the above-mentioned descriptions, the duplication of six copies is only for the illustration only, and the invention is not restricted thereto.

In summary, in the embodiment of the invention, even if the back-end circuit has lower bit number (e.g., the bit number of the digital-to-analog converter 330 is lower than the bit number of the digital gamma correction unit 310 in FIG. 3), the image-dithering unit (having the bit number the same as the bit number of the digital-to-analog converter 330 but lower than the bit number of the digital gamma correction unit 310) may utilize the image-dithering to compensate the bit mantissa, which cannot be processed by the digital-to-analog converter 330, into high bit in order to avoid the waste of the bit number and to obtain more color richness.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A liquid crystal display (LCD), comprising:

a data source, for generating N-bit pixel data, N being a positive integer;

a digital gamma correction unit, coupled to the data source, for performing digital gamma correction on the pixel data to generate (N+M)-bit digital gamma correction pixel data whose mantissa is the lowest K bits of the (N+M) bits, K and M being positive integers;

an image-dithering unit, coupled to the digital gamma correction unit, for performing image-dithering on the digital gamma correction pixel data to generate a plurality of (N+M−K)-bit dithering compensation pixel data in consecutive frames wherein in generating the (N+M−K)-bit dithering compensation pixel data in the consecutive frames, the K-bit mantissa is removed from the (N+M)-bit digital gamma correction pixel data and added to the (N+M−K)-bit dithering compensation pixel data of at least one frame of the consecutive frames for compensating the plurality of (N+M−K)-bit dithering compensation pixel data of the consecutive frames; and a converter, coupled to the image-dithering unit, for converting the dithering compensation pixel data into an output image, wherein a bit number of the converter is lower than a bit number of the digital gamma correction unit.

2. The LCD according to claim 1, wherein, the image-dithering unit comprises a plurality of non-symmetrical polarity image-dithering compensation tables, the image-dithering unit duplicates and staggers a plurality of original dithering compensation tables to obtain a plurality of first intermediate dithering compensation tables;

the image-dithering unit shifts the first intermediate dithering compensation tables to obtain a plurality of second intermediate dithering compensation tables; and the image-dithering unit combines the second intermediate dithering compensation tables to obtain the image-dithering compensation tables.

3. The LCD according to claim 2, wherein while the image-dithering unit duplicates and staggers the original dithering compensation tables, the image-dithering unit inserts a respective blank column adjacent to each of columns of the original dithering compensation tables, and the image-dithering unit makes two of the original dithering compensation tables having the inserted blank columns in a mirror relationship to obtain the first intermediate dithering compensation tables.

4. The LCD according to claim 3, wherein while the image-dithering unit shifts the first intermediate dithering compensation tables, the image-dithering unit does not shift a to-be-compensated pixel in the same column but shifts another to-be-compensated pixel in the same column to the blank column to obtain the second intermediate dithering compensation tables.

5. The LCD according to claim 4, wherein while the image-dithering unit combines the second intermediate dithering compensation tables, the image-dithering unit combines a column of a positive polarity second intermediate dithering compensation table of the second intermediate dithering compensation tables with an associated blank column of a negative polarity second intermediate dithering compensation table to obtain the image-dithering compensation tables.

6. The LCD according to claim 1, wherein, the image-dithering unit comprises a plurality of independent-polarity and independent-pixel-data image-dithering compensation tables;

the image-dithering unit develops, duplicates and combines a plurality of original dithering compensation tables to obtain the independent-polarity and independent-pixel data image-dithering compensation tables.

7. An image-dithering compensation method, applicable to a liquid crystal display (LCD), the method comprising:

performing digital gamma correction on N-bit pixel data to generate (N+M)-bit digital gamma correction pixel data whose mantissa is the lowest K bits of the (N+M) bits, K, N and M being positive integers;

performing image-dithering on the digital gamma correction pixel data to generate a plurality of (N+M−K)-bit dithering compensation pixel data in consecutive frames wherein in generating the (N+M−K)-bit dithering compensation pixel data in the consecutive frames, the K-bit mantissa is removed from the (N+M)-bit digital gamma correction pixel data and added to the (N+M−K)-bit dithering compensation pixel data of at least one frame of the consecutive frames for compensating the plurality of (N+M−K)-bit dithering compensation pixel data of the consecutive frames; and converting the dithering compensation pixel data into a (N+M-K)-bit output image.

8. The method according to claim 7, further comprising utilizing a plurality of non-symmetrical polarity image-dithering compensation tables to perform the image-dithering on the digital gamma correction pixel data to generate the dithering compensation pixel data;

duplicating and staggering a plurality of original dithering compensation tables to obtain a plurality of first intermediate dithering compensation tables;

shifting the first intermediate dithering compensation tables to obtain a plurality of second intermediate dithering compensation tables; and combining the second intermediate dithering compensation tables to obtain a plurality of image-dithering compensation tables.

9. The method according to claim 8, wherein in duplicating and staggering the original dithering compensation tables, a respective blank column is inserted adjacent to each of columns of the original dithering compensation tables, and the two original dithering compensation tables having the inserted blank columns have a mirror relationship to obtain the first intermediate dithering compensation tables.

10. The method according to claim 9, wherein in shifting the first intermediate dithering compensation tables, a to-be-compensated pixel in the same column is not shifted and another to-be-compensated pixel in the same column is shifted to the blank column to obtain the second intermediate dithering compensation tables.

11. The method according to claim 10, wherein said combining the second intermediate dithering compensation tables includes combining a column of a positive polarity second intermediate dithering compensation table of the second intermediate dithering compensation tables with an associated blank column of a negative polarity second intermediate dithering compensation table to obtain the image-dithering compensation tables.

12. The method according to claim 7, further comprising utilizing a plurality of independent-polarity and independent-pixel-data image-dithering compensation tables to perform the image-dithering on the digital gamma correction pixel data to generate the dithering compensation pixel data; and developing, duplicating and combining a plurality of original dithering compensation tables to obtain the independent-polarity and independent-pixel-data image-dithering compensation tables.

* * * * *